US007158741B2

(12) United States Patent
Kim et al.

(10) Patent No.: US 7,158,741 B2
(45) Date of Patent: Jan. 2, 2007

(54) DEVELOPING DEVICE FOR LIQUID ELECTROPHOTOGRAPHIC IMAGE FORMING APPARATUS

(75) Inventors: Sung-dae Kim, Suwon-si (KR); Kyu-cheol Shin, Gwacheon-si (KR); In-yong Song, Suwon-si (KR); Joong-gwang Shin, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/916,550

(22) Filed: Aug. 12, 2004

(65) Prior Publication Data

US 2005/0053398 A1 Mar. 10, 2005

(30) Foreign Application Priority Data

Sep. 5, 2003 (KR) ..... 10-2003-0062177

(51) Int. Cl.
*G03G 15/10* (2006.01)

(52) U.S. Cl. ..... 399/237

(58) Field of Classification Search ..... 399/237, 399/256, 359, 360, 347, 348
See application file for complete search history.

(56) References Cited

U.S. PATENT DOCUMENTS 4,011,835 A * 3/1977 Lewis ..... 399/254
4,728,987 A 3/1988 Diola et al. ..... 355/3
5,515,141 A 5/1996 Hanson ..... 355/256
5,572,299 A * 11/1996 Kato et al. ..... 399/256
6,456,809 B1 * 9/2002 Sekiguchi ..... 399/254
2002/0025173 A1 * 2/2002 Isobe et al. ..... 399/12
2004/0096242 A1 * 5/2004 Murakami ..... 399/258

FOREIGN PATENT DOCUMENTS

JP 11-102122 4/1999
JP 11102122 A * 4/1999
JP 2001-228717 8/2001

* cited by examiner

*Primary Examiner*—Quana Grainger
(74) *Attorney, Agent, or Firm*—Roylance, Abrams, Berdo & Goodman, L.L.P.

(57) ABSTRACT

A developing device for a liquid electrophotographic image forming apparatus is provided. The developing device may have a developing roller, which supplies ink to a photosensitive body on which an electrostatic latent image is formed and develops the electrostatic latent image. The apparatus may include an ink reservoir in which ink supplied to the developing roller is accommodated, and an ink removal unit, which removes ink remaining in the ink reservoir after a development operation is performed. The ink removal unit may comprise an ink removal member rotatably installed in the ink reservoir that exhausts ink through a through hole formed under the ink reservoir. A driving member rotates the ink removal member. An ink cartridge stores ink exhausted through the through hole.

15 Claims, 7 Drawing Sheets

FG

DEVELOPING DEVICE FOR LIQUID ELECTROPHOTOGRAPHIC IMAGE FORMING APPARATUS

BACKGROUND OF THE INVENTION

This application claims the benefit under 35 U.S.C. § 119(a) of Korean Patent Application No. 2003-62177, filed on Sep. 5, 2003, in the Korean Intellectual Property Office, the disclosure of which is herein incorporated by reference in its entirety.

1. Field of the Invention

The present invention relates to a liquid electrophotographic image forming apparatus. More particularly, the present invention relates to a developing device for a liquid electrophotographic image forming apparatus, which removes substantially all of the ink remaining in an ink reservoir after a printing operation is performed, thereby lengthening the life span of the developing device.

2. Description of the Related Art

In general, liquid electrophotographic image forming devices form an electrostatic latent image which corresponds to a desired image by radiating light on a photosensitive body. The electrostatic latent image is developed with ink having a predetermined color, thereby obtaining a desired image.

FIG. 1 illustrates a conventional developing device for a liquid electrophotographic image forming apparatus. Referring to FIG. 1, the conventional developing device for a liquid electrophotographic image forming apparatus includes an ink cartridge 40 in which ink is stored, an ink reservoir 26 in which ink supplied from the ink cartridge 40 is accommodated, and a developing roller 12 which develops an electrostatic latent image formed on a photosensitive body 10 with ink supplied from the ink reservoir 26.

A deposit roller 16 which applies ink from the ink reservoir 26 to the surface of the developing roller 12, a metering roller 14 which regulates ink applied to the surface of the developing roller 12 to a predetermined thickness, and a cleaning roller 18 which cleans undeveloped ink from the surface of the developing roller 12 after development. The deposit roller 16, metering roller 14 and cleaning roller 18 are located around developing roller 12. A light scanning unit (LSU) 20 forms an electrostatic latent image by radiating light on the photosensitive body 10, and a cleaning blade 22 removes ink remaining on the surface of the photosensitive body 10. Also, a waste ink reservoir 24 holds waste ink removed by the cleaning blade 22.

In the above structure, if a first pump P1 is driven during the development operation, ink is supplied to the ink reservoir 26 from the ink cartridge 40 through a first through hole 30. Subsequently, ink is supplied by the deposit roller 16 to the developing roller 12, and the developing roller 12 is rotated while contacting the photosensitive body 10, thereby developing the electrostatic latent image formed on the photosensitive body 10. Ink leaking out of the ink reservoir 26 is collected in an ink container 28. Subsequently, ink flows through a second through hole 32 and is returned to the ink cartridge 40 for storage. To this end, a second pump P2 is located in the path connecting the ink cartridge 40 to the ink container 28.

Meanwhile, if a printing operation is completed, the first pump P1 is driven in the reverse direction and ink remaining in the ink reservoir 26 flows through the first through hole 30 and is returned to the ink cartridge 40.

FIGS. 2A and 2B respectively show an elevation view and a cross-sectional view illustrating a structure of the ink reservoir 26 of FIG. 1. Referring to FIGS. 2A and 2B, the first through hole 30 for supplying and removing ink is formed under the ink reservoir 26, and a bottom surface of the ink reservoir 26 is inclined toward the first through hole 30. Ink in the ink reservoir 26 moves to the first through hole 30 by gravity. However, high-concentration ink does not flow quickly by gravity alone. Even though high-concentration ink moves to the first through hole 30 by gravity, the amount of time required may be reduced by using a mechanical means to assist the movement of the ink to the first through hole 30.

SUMMARY OF THE INVENTION

The present invention provides a developing device for a liquid electrophotographic image forming apparatus, which comprises an ink removal unit for removing substantially all of the ink remaining in an ink reservoir after a printing operation is performed, thereby lengthening the life span of the developing device.

According to an embodiment of the present invention, there is provided a developing device for a liquid electrophotographic image forming apparatus, the developing device comprising a developing roller, which supplies ink to a photosensitive body on which an electrostatic latent image is formed, and develops the electrostatic latent image; an ink reservoir in which ink supplied to the developing roller is accommodated; and an ink removal unit, which removes ink remaining in the ink reservoir after a development operation is performed, wherein the ink removal unit comprises an ink removal member, which is rotatably installed in the ink reservoir and rotates to urge ink through a through hole formed under the ink reservoir; a driving member, which rotates the ink removal member; and an ink cartridge, which stores ink removed through the through hole. The ink removal member may include first and second screw springs, which are located on opposite sides of the through hole and rotate to move ink in the ink reservoir to the through hole.

One end of each of the first and second screw springs may be rotatably installed on opposite ends of the ink reservoir, respectively. The other end of each of the first and second screw springs may be connected to each other. Joint rings may be formed on this other end of each of the first and second screw springs to connect them to each other. A driving member may be connected to one end of each of the first and second screw springs.

The bottom internal surface of the ink reservoir may be inclined toward the through hole. Each of the first and second screw springs may have a cylindrical shape or a taper shape such that a diameter thereof becomes larger as the first and second screw springs extend toward the through hole. The ink removal member may further include shaft mounts, which support the other end of each of the first and second screw springs to be rotated.

The bottom internal surface of the ink reservoir may be flat. In this case, the other end of each of the first and second screw springs may be connected to each other to be parallel to the bottom surface of the ink reservoir. The ink removal member may include first and second screws, which are located on opposite sides of the through hole and rotate to move ink in the ink reservoir to the through hole. One end of each of the first and second screws may be rotatably installed on opposite ends of the ink reservoir, and the other end of each of the first and second screws may be connected to each other. The driving member may be connected to one end of either the first or second screws or both. The bottom internal surface of the ink reservoir may be inclined toward the through hole. The ink removal member may further include shaft mounts, which support the other end of each of the first and second screws to be rotated.

BRIEF DESCRIPTION OF THE DRAWINGS

The above and other aspects of the present invention will become more apparent by describing in detail an exemplary embodiment thereof with reference to the attached drawings in which.

DETAILED DESCRIPTION OF EXEMPLARY EMBODIMENTS

Hereinafter, an exemplary embodiment of the present invention will be described in detail with reference to the attached drawings.

Figure 1:
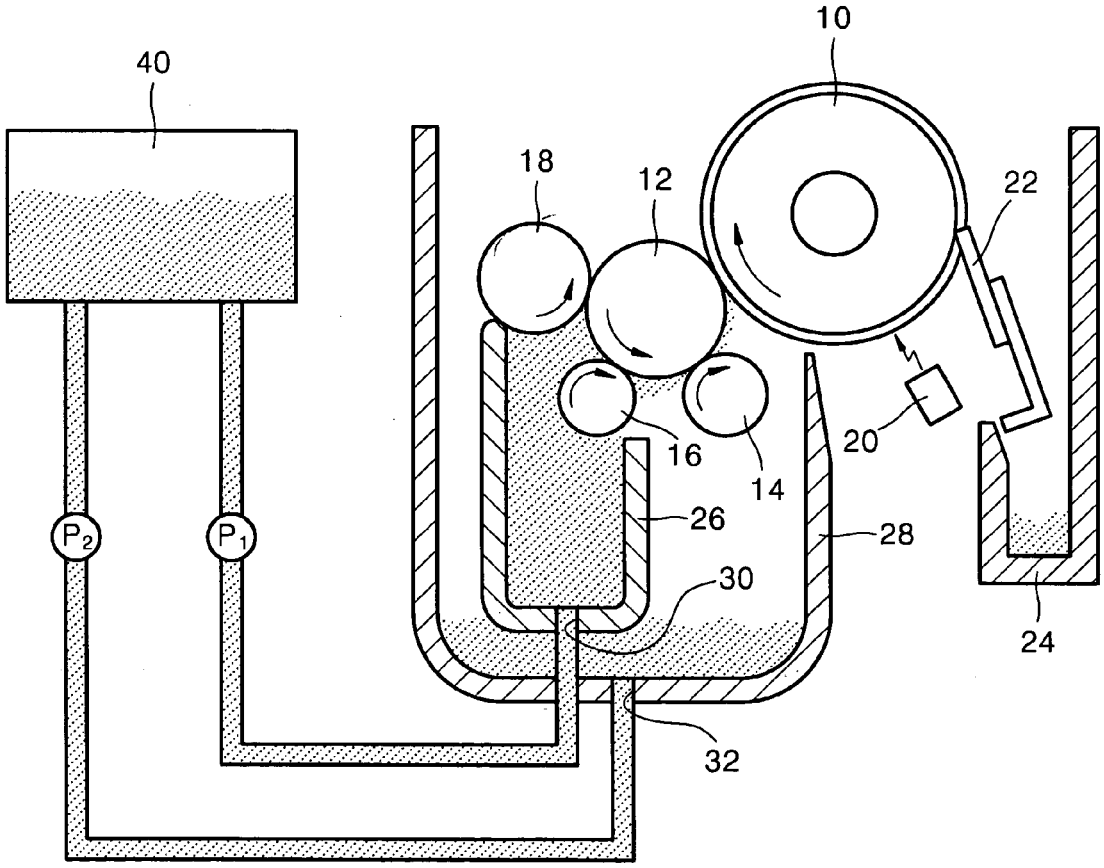
FIG. 1 (PRIOR ART)
FIG. 1 schematically illustrates a conventional developing device for a liquid electrophotographic image forming apparatus.
Figure 2A:
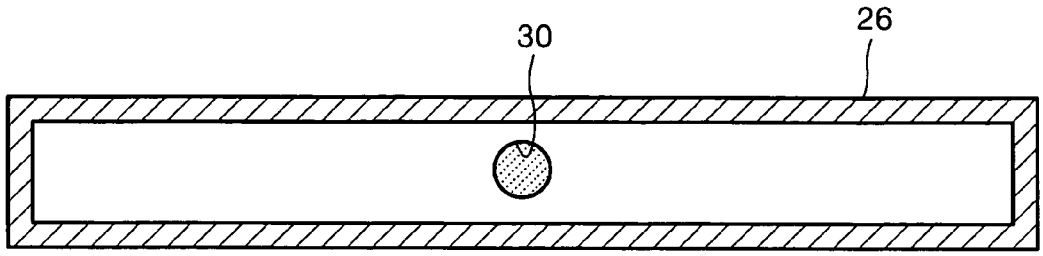
FIG. 2A (PRIOR ART)
FIGS. 2A and 2B respectively show a plane view and a cross-sectional view illustrating a structure of an ink reservoir of FIG. 1.
Figure 2B:
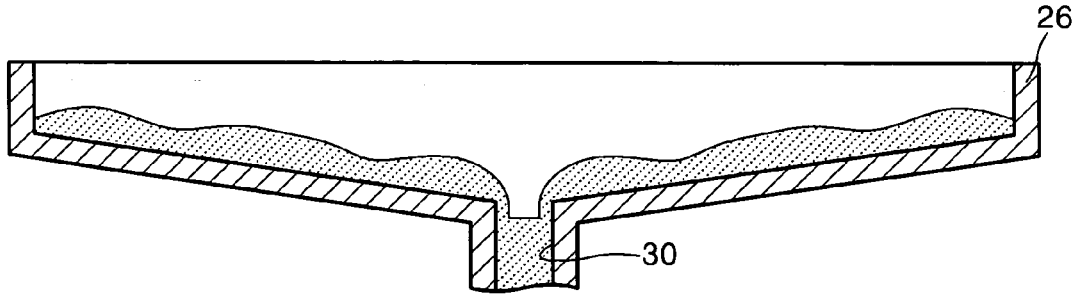
FIG. 2B (PRIOR ART)
Figure 3:
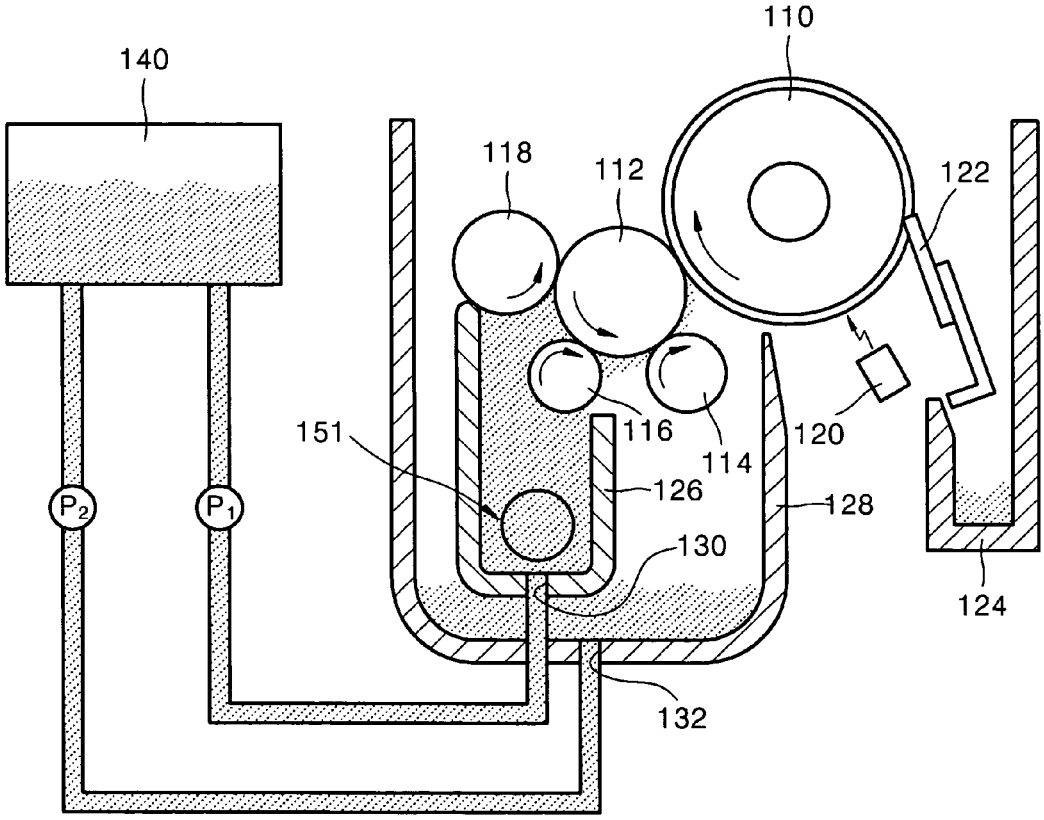
FIG. 3 schematically illustrates a developing device for a liquid electrophotographic image forming apparatus according to an embodiment of the present invention.

Referring to FIG. 3, the developing device for a liquid electrophotographic image forming apparatus according to the embodiment of the present invention includes a developing roller 112 which develops an electrostatic latent image formed on a photosensitive body 110, an ink reservoir 126 in which ink supplied to the developing roller 112 is accommodated, and an ink removal unit 151 which removes ink remaining in the ink reservoir 126 after a printing operation is performed. The developing roller 112 faces the photosensitive body 110, is rotated, and supplies ink to the photosensitive body 110 on which the electrostatic latent image is formed. A deposit roller 116 which applies ink in the ink reservoir 126 to the surface of the developing roller 112, a metering roller 114 regulates the thickness of ink on the surface of the developing roller 112, and a cleaning roller 118, which removes ink left undeveloped from the surface of the developing roller 112 after development, contacts the developing roller 112. The light scanning unit (LSU) 120 forms an electrostatic latent image by radiating light on the photosensitive body 110, and cleaning blade 122 removes ink remaining on the surface of the photosensitive body 110. A waste ink reservoir 124 holds waste ink removed by the cleaning blade 122. Ink is supplied to the ink reservoir 126 from an ink cartridge 140, which will be described later.

Figure 4A:
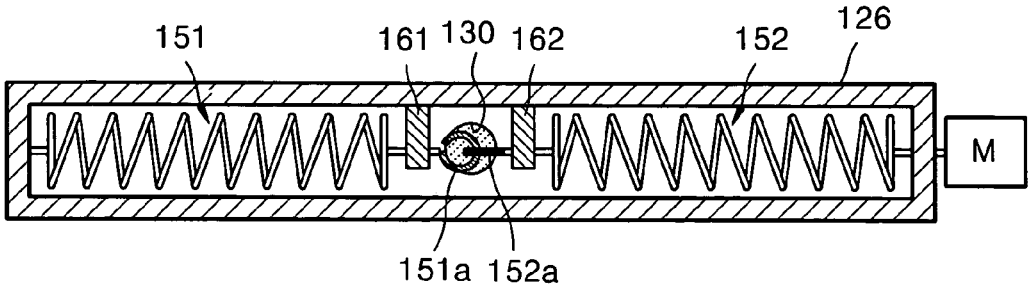
FIGS. 4A and 4B respectively show a plane view and a cross-sectional view illustrating a structure of an ink reservoir of FIG. 3.
Figure 4B:
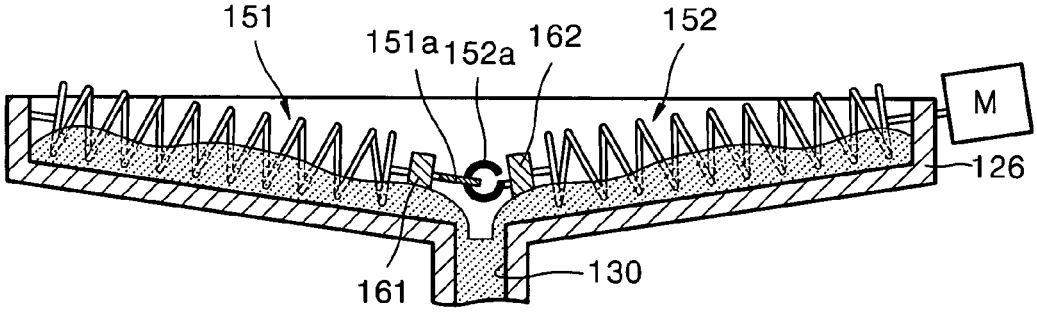
Figure 5:
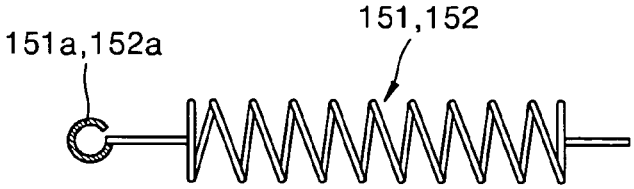
FIG. 5 illustrates screw springs having a cylindrical shape of FIGS. 4A and 4B.

As shown in FIGS. 4A and 4B, a first through hole 130 through which ink flows is in the bottom of the ink reservoir 126, and the bottom surface of the ink reservoir 126 is inclined toward the first through hole 130. The ink removal unit includes an ink removal member, which is rotatably installed in the ink reservoir 126, to be rotated by driving motor M to remove ink through the first through hole 130 The ink is removed through the first the first through hole 130 and returns to ink cartridge 140. The ink removal member includes first and second screw springs 151 and 152, which rotate and are located on either side of the first through hole 130 and move ink in the ink reservoir 126 towards the first through hole 130. As shown in FIG. 5, each of the first and second screw springs 151 and 152 is a spring having a cylindrical shape. The screw springs (151 and 152) terminate with a portion of the spring protruding horizontally from the center of the cylindrically-shaped screw spring. One end of screw spring 151 rotatably connects to the side of ink reservoir 126 while the other end terminates with a joint ring 151*a*. The screw spring 151 and joint ring 151*a* may be supported by shaft support 161, which contacts the screw spring 151 prior to the point where joint ring 151*a* connects to the spring screw 151. One end of screw spring 152 connects to drive motor M, while the other end terminates with joint ring 152*a* which is connected to joint ring 151*a* of screw spring 151. Similar to shaft support 161, shaft support 162 supports spring screw 152 and joint ring 152*a*. Both supports 161 and 162 prevent the occurrence of runout.

Drive motor M causes the second screw spring 152 placed near the driving motor M to rotate. A rotating force of the second screw spring 152 is transferred by the joint rings 152*a* and 151*a* to the first screw spring 151 causing the first screw spring 151 to rotate. Any nonuniform forces or twisted deformations generated are absorbed by the first and second screw springs 151 and 152, such that the first and second screw springs smoothly rotate. Of course, the driving motor M may be connected to one end of the first screw spring 151 instead of spring screw 152.

Meanwhile, when the driving motor M is driven, the first and second screw springs 151 and 152 are rotated in the same direction, but move the ink from the sides of the ink reservoir 126 towards first through hole 130 at the center of the ink reservoir 126 because the orientation of first screw spring 151 is opposite that of second screw spring 152.

Shaft mounts 161 and 162 which support the end of each of the first and second screw springs 151 and 152, so that run-out does not occur when the first and second screw springs 151 and 152 are rotated, are located on the ends of screw springs 151 and 152 closest to joint rings 151*a* and 152*a*, respectively.

The ink cartridge 140 stores ink supplied to the ink reservoir 126 and from the ink reservoir 126 when ink is removed through the first through hole 130. To this end, a first pump P1 is located between the ink cartridge 140 and the ink reservoir 126. First pump P1 pumps ink from the ink cartridge 140 to the ink reservoir 126 during the development operations. But during the ink removal operations, first pump P1 pumps in the opposite direction pumping ink from the ink reservoir 126 to the ink cartridge 140.

Meanwhile, ink leaking out of the ink reservoir 126 during development is collected in an ink container 128. Then, ink collected in the ink container 128 is exhausted through a second through hole 132 and is stored in the ink cartridge 140. A second pump P2 is located in the path connecting the ink cartridge 140 and the ink container 128. The above-described developing device is provided for each color in a color image forming apparatus for superimposing a plurality of colors and performing a printing operation.

Referring to FIG. 3, if the first pump P1 is driven to perform a development operation, ink is supplied to the ink reservoir 126 from the ink cartridge 140 through the first through hole 130. Subsequently, ink accommodated in the ink reservoir 126 is supplied by the deposit roller 116 to the developing roller 112, and the developing roller 112 faces the photosensitive body 110. The developing roller 112 rotates to develop the electrostatic latent image formed on the photosensitive body 110. When the printing operation is completed, the driving motor M is driven to remove ink remaining in the ink reservoir 126. To remove the ink, the first and second screw springs 151 and 152 are rotated. By rotating the first and second screw springs 151 and 152, ink remaining in the ink reservoir 126 quickly moves toward the first through hole 130 and is removed through the first through hole 130. By driving the first pump P1, ink removed through the first through hole 130 is stored in the ink cartridge 140. In this case, the first pump P1 is driven in the reverse direction than when supplying to the ink reservoir 126. In the ink removal unit described above, substantially all of the ink remaining in the ink reservoir 126 after the printing operation is performed is quickly removed.

Figure 6A:
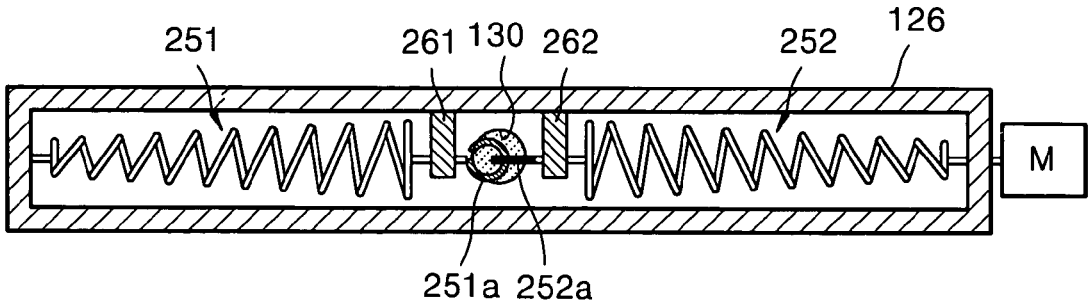
FIGS. 6A and 6B respectively show a plane view and a cross-sectional view illustrating a structure of an ink reservoir in which another example of an ink removal member is installed, in the developing device for a liquid electrophotographic image forming apparatus according to an embodiment of the present invention.
Figure 6B:
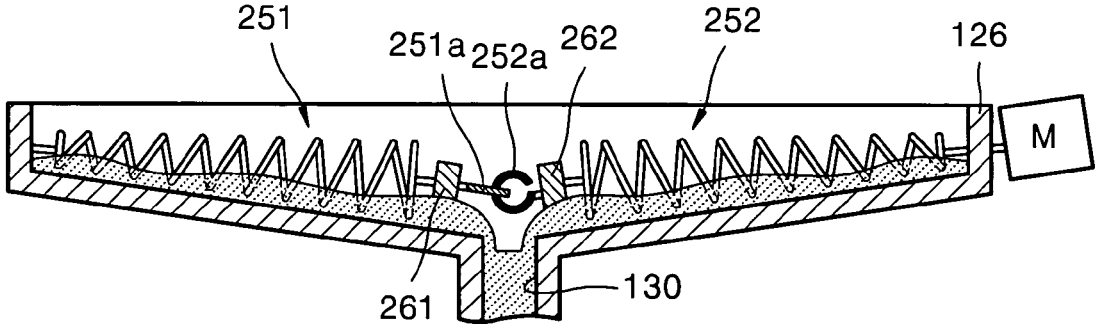
Figure 7:
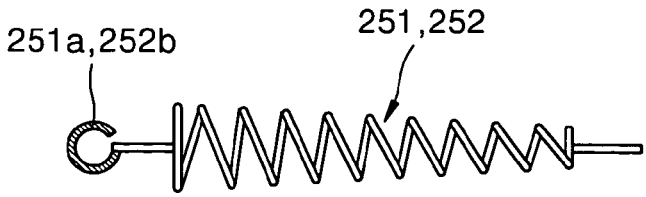
FIG. 7 illustrates screw springs having a taper shape of FIGS. 6A and 6B.

Referring to FIGS. 6A, 6B, and 7, the ink removal member includes first and second screw springs 251 and 252, which are located on opposite sides of the first through hole 130 and rotate to move ink in the ink reservoir 126 to the first through hole 130. In this embodiment, each of the first and second screw springs 251 and 252 has a taper shape such that a diameter thereof becomes larger as the first and second screw springs 251 and 252 extend toward the first through hole 130. As stated above, the other end of each of the first and second screw springs 251 and 252 is connected together by joint rings 251*a* and 252*a*. Shaft mounts 261 and 262 support the other end of each of the first and second screw springs 251 and 252 so that run-out does not occur when the first and second screw springs 251 and 252 are rotated. Shaft mounts 261 and 262 are located adjacent to where the first and second screw springs 251 and 252, respectively, are connected together. If each of the first and second screw springs 251 and 252 has the taper shape, the heights of the first and second screw springs 251 and 252 are preferably not greater than the heights of both sides of the ink reservoir 126. Therefore, interference with components coupled with the ink reservoir 126 is reduced.

Figure 8A:
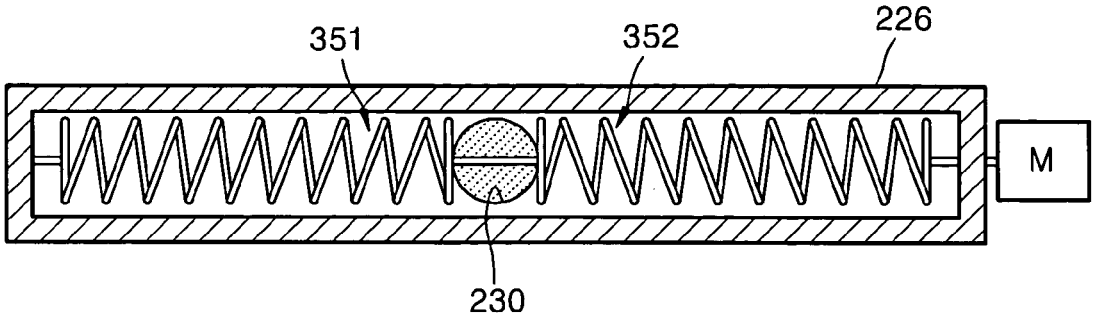
FIGS. 8A and 8B respectively show a plane view and a cross-sectional view illustrating a structure of an ink reservoir in which another example of an ink removal member is installed, in the developing device for a liquid electrophotographic image forming apparatus according to an embodiment of the present invention.
Figure 8B:
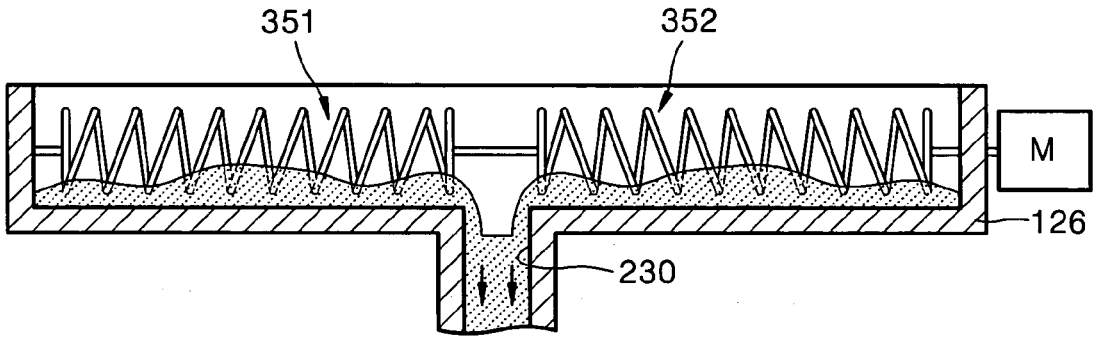
Figure 9:
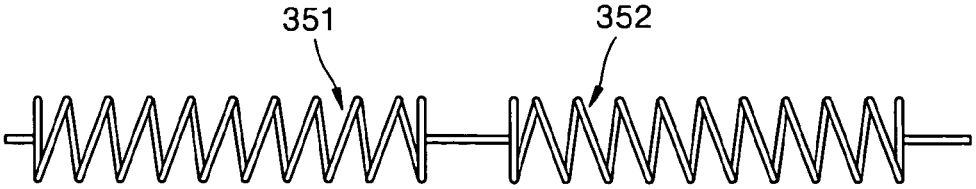
FIG. 9 illustrates screw springs of FIGS. 8A and 8B.

Referring to FIGS. 8A, 8B, and 9, first, a first through hole 230 is formed under the ink reservoir 226, and the bottom surface of the ink reservoir 226 is flat. The ink removal member includes first and second screw springs 351 and 352, which are disposed at both sides of the first through hole 230 and move ink in the ink reservoir 226 to the first through hole 230 by rotation. In this embodiment, the first and second screw springs 351 and 352 are connected to each other as a single body and are installed to be parallel to the bottom surface of the ink reservoir 226.

Figure 10A:
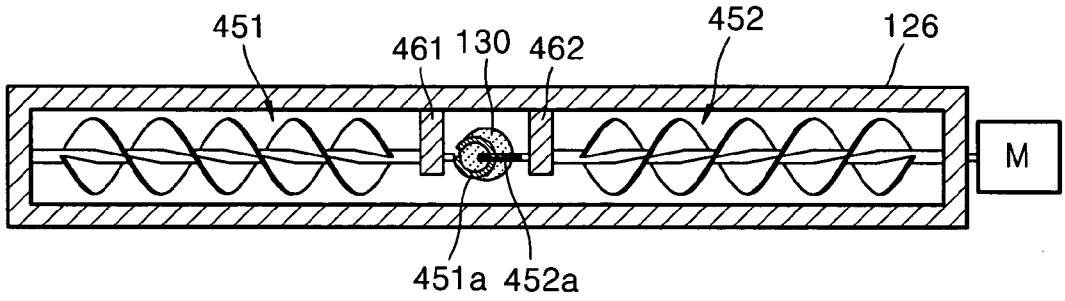
FIGS. 10A and 10B respectively show a plane view and a cross-sectional view illustrating a structure of an ink reservoir in which another ink removal member is installed, in the developing device for a liquid electrophotographic image forming apparatus according to an embodiment of the present invention.
Figure 10B:
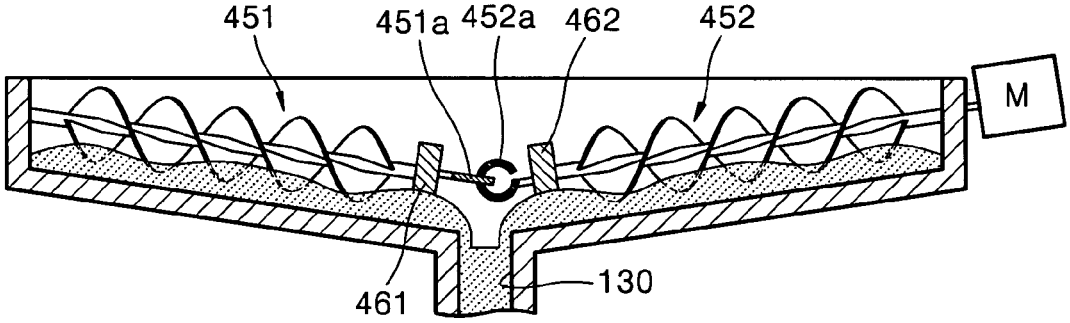
Figure 11:
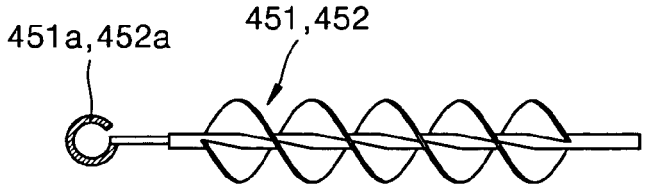
FIG. 11 illustrates screws of FIGS. 10A and 10B.

Referring to FIGS. 10A, 10B, and 11, the ink removal member includes first screw 451 located on one side of through hole 130 and a second screw 452 located on the opposite side of through hole 130. As the first 451 and second screws 452 rotate, ink is moved towards through hole 130 for removal from reservoir 126. The end closest to through hole 130 of each of the first and second screws 451 and 452 is connected together by joint rings 451*a* and 452*a*. Shaft mounts 461 and 462 support the end of each of the first and second screws 451 and 452 closest to the joint rings 451*a* and 452*a*.

As described above, the developing device for a liquid electrophotographic image forming apparatus according to an embodiment of the present invention has the following effects. First, substantially all of the ink remaining in an ink reservoir after completing a printing operation is quickly removed. Second, ink is prevented from sticking to the ink reservoir when a developing device is not used for a long time, thereby lengthening the life span of the developing device. Lastly, ink is prevented from leaking from the ink reservoir when a user handles the developing device.

While this invention has been particularly shown and described with reference to a preferred embodiment thereof, it will be understood by those skilled in the art that various changes in form and details may be made therein without departing from the spirit and scope of the invention as defined by the appended claims and equivalents thereof.

What is claimed is:

1. A developing device for a liquid electrophotographic image forming apparatus, the developing device comprising:

a developing roller, which supplies ink to a photosensitive body on which an electrostatic latent image is formed, and develops the electrostatic latent image;

an ink reservoir in which ink supplied to the developing roller is accommodated;

an ink removal unit, which removes ink remaining in the ink reservoir after a development operation is performed, and wherein the ink removal unit comprises:

an ink removal member, which is rotatably installed in the ink reservoir and rotates to remove ink through a through hole formed under the ink reservoir by rotation, wherein the ink removal member includes first and second screw springs, which are located on opposite sides of the through hole and rotate to move ink in the ink reservoir to the through hole and wherein one end of each of the first and second screw springs is rotatably installed on opposite ends of the ink reservoir, and the other end of each of the first and second screw springs are connected to each other;

a driving member, which rotates the ink removal member; and an ink cartridge, which stores ink exhausted through the through.

2. The device of claim 1, wherein joint rings are formed on the other end of either of the first or second screw springs.

3. The device of claim 1, wherein the driving member is connected to one end of each of the first and second screw springs.

4. The device of claim 1, wherein a bottom surface of the ink reservoir is inclined toward the through hole.

5. The device of claim 4, wherein each of the first and second screw springs has a cylindrical shape.

6. The device of claim 4, wherein each of the first and second screw springs has a taper shape such that a diameter thereof becomes larger as the first and second screw springs extend toward the through hole.

7. The device of claim 6, wherein said taper shape of said first and second screw springs corresponds to the incline of said ink reservoir.

8. The device of claim 4, wherein the ink removal member further includes shaft mounts, which support the other end of each of the first and second screw springs while the first and second screw springs are rotated.

9. The device of claim 1, wherein a bottom surface of the ink reservoir is flat.

10. The device of claim 9, wherein the other end of each of the first and second screw springs are connected to each other and are parallel to the bottom surface of the ink reservoir.

11. The device of claim 1, wherein the ink cartridge supplies ink to the ink reservoir and stores ink exhausted through the through hole when ink is removed from the ink reservoir for return to the ink cartridge.

12. A developing device for a liquid electrophotographic image forming apparatus, the developing device comprising:

a developing roller, which supplies ink to a photosensitive body on which an electrostatic latent image is formed, and develops the electrostatic latent image;

an ink reservoir in which ink supplied to the developing roller is accommodated;

an ink removal unit, which removes ink remaining in the ink reservoir after a development operation is performed, and wherein the ink removal unit comprises:

an ink removal member, which is rotatably installed in the ink reservoir and rotates to remove ink through a through hole formed under the ink reservoir by rotation;

a driving member, which rotates the ink removal member; and an ink cartridge, which stores ink exhausted through the through, wherein the ink removal member includes first and second screws, which are located on opposite sides of the through hole and when rotated move ink in the ink reservoir towards the through hole and wherein one end of each of the first and second screws is rotatably installed on either side of the ink reservoir, and the other end of each of the first and second screws are connected to each other.

13. The device of claim 12, wherein the driving member is connected to one end of either the first or second screws.

14. The device of claim 12, wherein a bottom surface of the ink reservoir is inclined toward the through hole.

15. The device of claim 14, wherein the ink removal member further includes shaft mounts, which support the other end of each of the first and second screws.

* * * * *